US009220345B2

(12) United States Patent
Davis et al.

(10) Patent No.: US 9,220,345 B2
(45) Date of Patent: Dec. 29, 2015

(54) PRESSURE-RELIEF PILLOWS

(71) Applicant: Banyan Licensing, L.L.C., Charlotte, NC (US)

(72) Inventors: Edmund Scott Davis, Clover, SC (US); Keith Richard Coponi, Oakland Park, FL (US); Calvin G. Tabor, Charlotte, NC (US)

(73) Assignee: BANYAN LICENSING L.L.C., Charlotte, NC (US)

( * ) Notice: Subject to any disclaimer, the term of this patent is extended or adjusted under 35 U.S.C. 154(b) by 0 days.

(21) Appl. No.: 13/754,577

(22) Filed: Jan. 30, 2013

(65) Prior Publication Data

US 2013/0198961 A1 Aug. 8, 2013

Related U.S. Application Data

(60) Provisional application No. 61/592,579, filed on Jan. 30, 2012.

(51) Int. Cl.

| | |
|---|---|
| ***A47C 7/02*** | (2006.01) |
| ***A47C 7/62*** | (2006.01) |
| ***A47C 7/18*** | (2006.01) |
| ***A47C 16/00*** | (2006.01) |
| ***A47G 9/10*** | (2006.01) |
| *A61G 5/10* | (2006.01) |

(52) U.S. Cl.

CPC ..... *A47C 7/022* (2013.01); *A47C 7/021* (2013.01); *A47C 7/18* (2013.01); *A47C 7/62* (2013.01); *A47C 16/00* (2013.01); *A47G 9/10* (2013.01); *A47G 2009/1018* (2013.01); *A61G 2005/1045* (2013.01)

(58) Field of Classification Search

CPC ..... A47C 7/022; A47C 7/021; A47C 7/18; A47C 16/00; A47C 7/62; A61G 7/05723; A61G 7/05707; A61G 2005/1045; A61G 2005/1091; A47G 9/10; A47G 2009/1018

USPC ..... 5/630, 632, 648, 652, 653, 655.9; D6/382, 388, 406.3, 406.4, 406.6, 596, D6/597, 601

See application file for complete search history.

(56) References Cited

U.S. PATENT DOCUMENTS

| | | | | | |
|---|---|---|---|---|---|
| 2,295,906 | A | * | 9/1942 | Lacour | 5/636 |
| 2,765,480 | A | * | 10/1956 | Mueller | 5/640 |
| 3,222,694 | A | * | 12/1965 | Schick | 5/653 |
| 3,376,070 | A | * | 4/1968 | Johnson | 297/452.26 |
| 3,503,649 | A | * | 3/1970 | Johnson | 297/452.26 |
| 4,118,813 | A | * | 10/1978 | Armstrong | 5/638 |
| 4,164,798 | A | * | 8/1979 | Weber | 297/452.26 |
| 5,018,231 | A | * | 5/1991 | Wang | 5/636 |

(Continued)

*Primary Examiner* — Nicholas Polito
*Assistant Examiner* — David R Hare
(74) *Attorney, Agent, or Firm* — Moore & Van Allen PLLC

(57) ABSTRACT

The invention is directed to a device comprising a body that defines a first surface and a second surface and defines a first, second, third and fourth lateral sides. In one embodiment, the first surface defines a first aperture and a second aperture. In one embodiment, the thickness of the body along the first lateral side is greater than the thickness of the body along the third lateral side such that the first surface slopes downwards from the first lateral side towards the third lateral side. The device not only reduces the pressure on the tailbone or on the hemorrhoids for a person in a seated position, but also reduces the discomfort or pain associated with settling into a seated position or emerging from a seated position.

20 Claims, 15 Drawing Sheets

(56) References Cited

U.S. PATENT DOCUMENTS

| | | | | | |
|---|---|---|---|---|---|
| 5,137,333 | A | * | 8/1992 | Chee | 297/452.21 |
| 5,189,747 | A | * | 3/1993 | Mundy et al. | 5/654 |
| 5,214,814 | A | * | 6/1993 | Eremita et al. | 5/636 |
| 5,457,832 | A | * | 10/1995 | Tatum | 5/636 |
| 5,461,741 | A | * | 10/1995 | Graebe | 5/654 |
| 5,479,667 | A | * | 1/1996 | Nelson et al. | 5/636 |
| 5,522,106 | A | * | 6/1996 | Harrison et al. | 5/653 |
| 5,681,092 | A | * | 10/1997 | Hanson et al. | 297/452.41 |
| D388,648 | S | * | 1/1998 | Bates | D6/601 |
| 5,845,352 | A | * | 12/1998 | Matsler et al. | 5/654 |
| D465,686 | S | * | 11/2002 | Hwong | D6/601 |
| D474,364 | S | * | 5/2003 | Arcieri | D6/601 |
| 6,574,809 | B1 | * | 6/2003 | Rathbun | 5/636 |
| 7,082,633 | B1 | * | 8/2006 | Maarbjerg | 5/636 |
| 7,216,388 | B2 | * | 5/2007 | Bieganek et al. | 5/653 |
| 7,516,504 | B2 | * | 4/2009 | Guez | 5/636 |
| 8,161,588 | B1 | * | 4/2012 | Anson | 5/636 |
| D673,410 | S | * | 1/2013 | O'Connell | D6/601 |
| D681,995 | S | * | 5/2013 | Davis et al. | D6/601 |
| 8,806,684 | B1 | * | 8/2014 | Ortega et al. | 5/636 |
| D728,272 | S | * | 5/2015 | Zimmerman | D6/601 |
| 2007/0294831 | A1 | * | 12/2007 | Siekman et al. | 5/653 |
| 2012/0304387 | A1 | * | 12/2012 | Crompton et al. | 5/632 |

* cited by examiner

PRESSURE-RELIEF PILLOWS

CROSS-REFERENCE TO RELATED APPLICATIONS

This patent application claims priority to and hereby incorporates by reference the entire contents of U.S. Provisional Patent Application No. 61/592,579 entitled "Pressure-Relief Pillows" filed on Jan. 30, 2012.

FIELD OF THE INVENTION

The present invention relates to support devices and, more specifically, pillows structured to provide pressure-relief in the coccyx region and in the affected-region of hemorrhoid patients.

BACKGROUND OF THE INVENTION

A pillow is generally useful for the purpose of rendering comfort or support to various parts of a person's body. A person suffering from or recovering from a tailbone injury (e.g., a coccyx fracture) or similar injury or condition may have trouble sitting due to the pressure or weight applied to the tailbone or area around the tailbone when in the seated position. A person suffering from hemorrhoids may also have trouble sitting due to the pressure or weight applied to the affected area when in the seated position. Sometimes, the discomfort or pain for a person suffering from a tailbone injury or hemorrhoids is greatest when in a seated position or when emerging from a seated position. Therefore, what is needed is a device that reduces the pressure on the area around the tailbone and/or on the affected area resulting from hemorrhoids for a person in a seated position. The device should not only reduces the pressure on the tailbone and/or on the affected area resulting from hemorrhoids for a person in a seated position, but should also reduce the discomfort or pain associated with settling into a seated position or emerging from a seated position.

SUMMARY OF THE INVENTION

Embodiments of the invention are directed to devices and methods for reducing the pressure on various parts of a person's body in a seated position. In one embodiment, an exemplary device comprises a body having a first lateral side with length L, a second lateral side with width W, a third lateral side with length L2, and a fourth lateral side with width W2. The body defines a first surface that is configured to receive the user's legs and gluteus maximus muscles when in the seated position and a second surface that is configured to contact the surface upon which the device is positioned (e.g., a car seat, a chair, a couch, a bed, the floor, etc.). In one embodiment, the body defines a first aperture extending at least partially into the first lateral side and the first surface. In one embodiment, the first aperture extends into the second surface of the body.

In one embodiment the thickness of the body along the first lateral side is greater than the thickness of the body along the third lateral side. In yet another embodiment, the thickness of the body is tapered or sloped from the first lateral side to the third lateral side, wherein the thickness of the body along the first lateral side is greater than the thickness of the body along the third lateral side.

In one embodiment, the first surface of the body defines at least one recess. In one embodiment, the first surface comprises a first recess within the corner defined by the second lateral side and the first lateral side and second recess within the corner defined by the fourth lateral side and the first lateral side, each configured to receive a respective gluteus maximus muscle of the user. In one embodiment, the first and second recesses are symmetrically positioned between the respective corner and the first aperture. In yet another embodiment, the first surface of the body defines a third recess within the corner defined by the second lateral side and the third lateral side and a fourth recess within the corner defined by the fourth lateral side and the third lateral side, each configured to receive a respective leg muscle of the user.

In one embodiment, the first surface of the body further comprises at least one raised portion extending from the third lateral side toward the first aperture. In one embodiment, the third and fourth recesses are symmetrically positioned between the respective corner and the raised portion.

In one embodiment, at least one of the first lateral side, the second lateral side, the third lateral side, and/or the fourth lateral side have a curvilinear configuration such the body has a substantially circular or elliptical shape.

In one embodiment, at least a portion of the first aperture extends from the first surface through the second surface and, in an alternate embodiment, at least a portion of the first aperture extends through the first surface toward the second surface but not through the second surface. In one embodiment, the first aperture extends from the first lateral side into the body toward the third lateral side. In one embodiment, the first aperture extends from the first lateral side into the body to a point at or near the centroid of the body. In one embodiment, the first aperture has a configuration of a channel. In another embodiment, the first aperture has a configuration selected from the group consisting of a substantially elliptical shape, a substantially rectangular shape, a substantially triangular shape, a substantially circular shape, a substantially square shape, or a substantially polygonal shape.

In one embodiment, the device further defines a bridge positioned at least partially within the first aperture. In one embodiment, the bridge is formed integrally with the body. In another embodiment, the bridge is formed separately from the body and attached to the body using adhesives or a mechanical fastener. In yet another embodiment, the bridge is detachably connected to the body.

In one embodiment, the body defines a second aperture. In one embodiment, the second aperture is positioned symmetrically about the centroid of the body. In one embodiment, the second aperture is offset from the centroid of the body toward at least one lateral side. In one embodiment, the second aperture has a configuration selected from the group consisting of a substantially elliptical shape, a substantially rectangular shape, a substantially triangular shape, a substantially circular shape, a substantially square shape, or a substantially polygonal shape.

In one embodiment, the device further comprises at least one lobe extending from a corner defined by two adjacent lateral sides. In one embodiment, the device defines a first lobe extending from the corner defined by the first and second lateral sides, a second lobe extending from the corner defined by the second and third lateral sides, a third lobe extending from the corner defined by the third and fourth lateral sides, and a fourth lobe extending from the corner defined by the fourth and first lateral sides. In one embodiment, the thickness of the at least one lobe is greater than the thickness of the body at the corresponding corner from which the lobe extends. In another embodiment, the thickness of the at least one lobe is less than the thickness of the body at the corresponding corner from which the lobe extends. In one embodiment, at least one lobe is formed integrally with the body. In another embodiment, at least one lobe is connected to the body using an adhesive or mechanical fastener. In yet another embodiment, at least one lobe is detachably connected to the body. In one embodiment, at least one lobe has at least a curvilinear configuration. In another embodiment, at least one of the lobe has a configuration selected from the group consisting of a substantially elliptical shape, a substantially rectangular shape, a substantially triangular shape, a substantially circular shape, a substantially square shape, or a substantially polygonal shape.

In one embodiment, a portion of the third lateral side has a curvilinear configuration. In one embodiment, the curvilinear configuration creates a concave surface. In another embodiment, the curvilinear configuration creates a convex surface.

In one embodiment, the device is substantially symmetrical about a line of axis that passes through the first aperture and is substantially parallel to the second and fourth lateral sides. In one embodiment, the device is substantially symmetrical about a line of axis that passes through the second aperture and is substantially parallel to the first and third lateral sides. In another embodiment, the device is substantially symmetrical about a line of axis that passes through the second aperture and is substantially parallel to the second and fourth lateral sides. In another embodiment, the device is substantially symmetrical about a line of axis that passes through the first aperture and is substantially parallel to the second and fourth lateral sides and a line of axis that passes through the second aperture and is substantially parallel to the first and third lateral sides.

In one embodiment, a width associated with at least one of the second or fourth lateral sides is either greater than or less than a length associated with at least one of the first or third lateral sides.

In one embodiment, the body is constructed of a high-density foam. In another embodiment, the body is constructed of pillow-filling material at least partially encased within a cover, wherein the pillow-filling material comprises at least one of foam, fluid, gas, wool, cotton, feather, polyester, or fiber. In one embodiment, the body further comprises a valve configured to allow the user to inject pillow-filling material into body or remove pillow-filling material from the body.

In one embodiment, an exemplary method for manufacturing a device comprises the steps of forming a body having a first lateral side with length L, a second lateral side with width W, a third lateral side with length L2, and a fourth lateral side with width W2, the body defining a first aperture extending at least partially into the first lateral side and the first surface. In one embodiment, the first aperture extends into the second surface of the body. In one embodiment, the method includes forming a second aperture in the body.

BRIEF DESCRIPTION OF THE DRAWINGS

Reference will now be made to the accompanying drawings, which are not necessarily drawn to scale, and wherein.

DETAILED DESCRIPTION OF THE INVENTION

Figure 1:
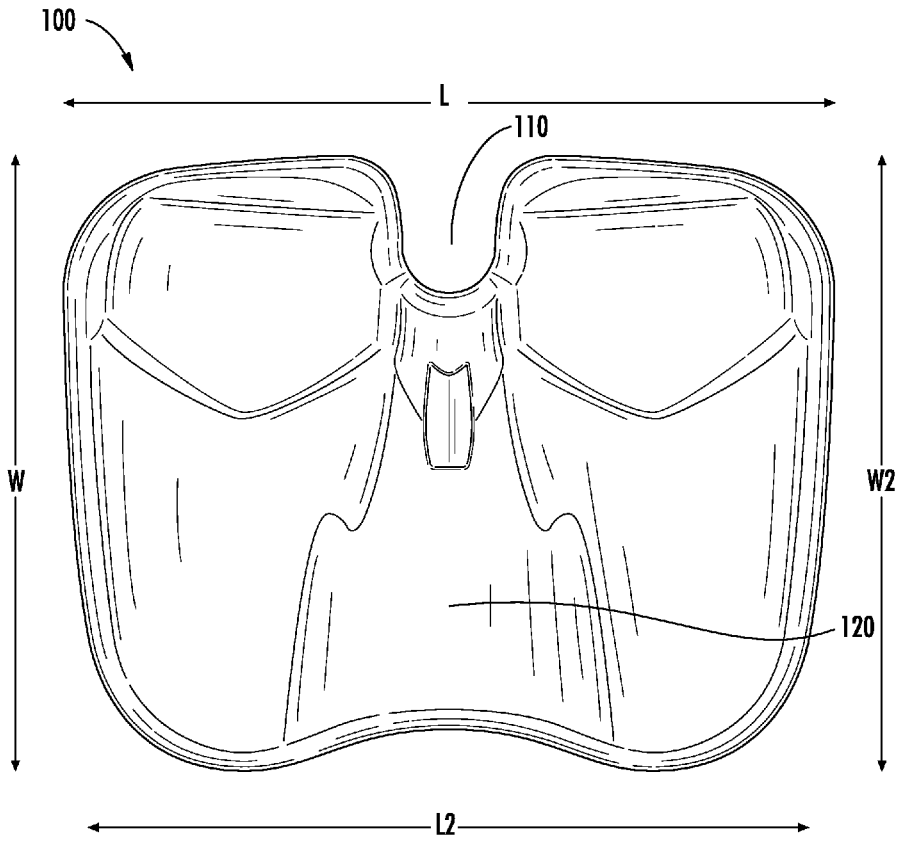
FIG. 1 is a top plan view illustrating a device, according to a first embodiment of the invention.

The present invention is directed to devices and methods for reducing the pressure on various parts of a person's body in a seated position. For example, a device according to the present invention provides pressure relief for affected body areas of people suffering from coccydynia and/or hemorrhoids. In one embodiment, an exemplary device comprises a body having a first lateral side with length L, a second lateral side with width W, a third lateral side with length L2, and a fourth lateral side with width W2. The body defines a first surface that is configured to receive the user's legs and gluteus maximus muscles when in the seated position and a second surface that is configured to contact the surface upon which the device is positioned (e.g., a car seat, a chair, a couch, a bed, the floor, etc.). In one embodiment, the first surface of the body defines a first aperture extending at least partially into the body. In one embodiment, the first aperture extends from the first lateral side toward the centroid of the body. In one embodiment, the first aperture extends at least partially through the second surface of the body. Like or similar reference numbers are used to identify features of the invention in the various embodiments described below.

A device according to the present invention includes a body. In some embodiments, the body is manufactured using "pillow-filling material". In embodiments where the pillow-filling material includes foam, the foam may be high resilient ("HR") urethane foam. The density of the urethane foam may be expressed as a two digit number. For example, #10 foam means there is 1.0 pounds of urethane chemical in each cubic foot of foam material. In the production of foam, there are two basic ingredients which are the urethane chemical that is the foam, and air. The more chemical that exists in the foam material, the higher its density rating will be. The invention is not limited to any particular density rating for the foam used in the device 100. Additionally, the invention is not limited to any particular indentation load deflection ("ILD") for the foam used in the device 100. The ILD is a measure of how much pressure it takes to compress the foam twenty-five percent (25%) of its thickness.

In other embodiments, pillow-filling material may include wool, feather, cotton, polyester, fiber, other synthetic material, fluid, or the like, or any combination thereof. As used herein, a fluid refers to a substance that has no fixed shape and yields easily to external pressure. Therefore, a fluid includes a liquid, a gas, or any combination thereof. The invention is not limited to any type of pillow-filling material that can be received into the body, provided the material provides the desired level of support and/or resiliency and/or comfort to the user when sitting on the device, when settling into a sitting position on the device, or when emerging from a sitting position on the device.

In one embodiment, the body may be manufactured by casting the pillow in a use-ready or near use-ready form. In another embodiment, the body is sculpted or shaping from a solid block of pillow-filling material. In another embodiment, the body may be manufactured to be substantially hollow, and the substantially hollow body may be filled at least partially with pillow-filling material. The substantially hollow body may be made of a flexible or cushioning material. In alternate embodiments, the body may be at least partially encased in a fitted or unfitted cover. The cover may be constructed of a variety of materials, including synthetic and natural fabrics and natural/synthetic blends. For purposes of example, and not limitation, the cover can be constructed of silk, cotton, or polyester.

Figure 2:
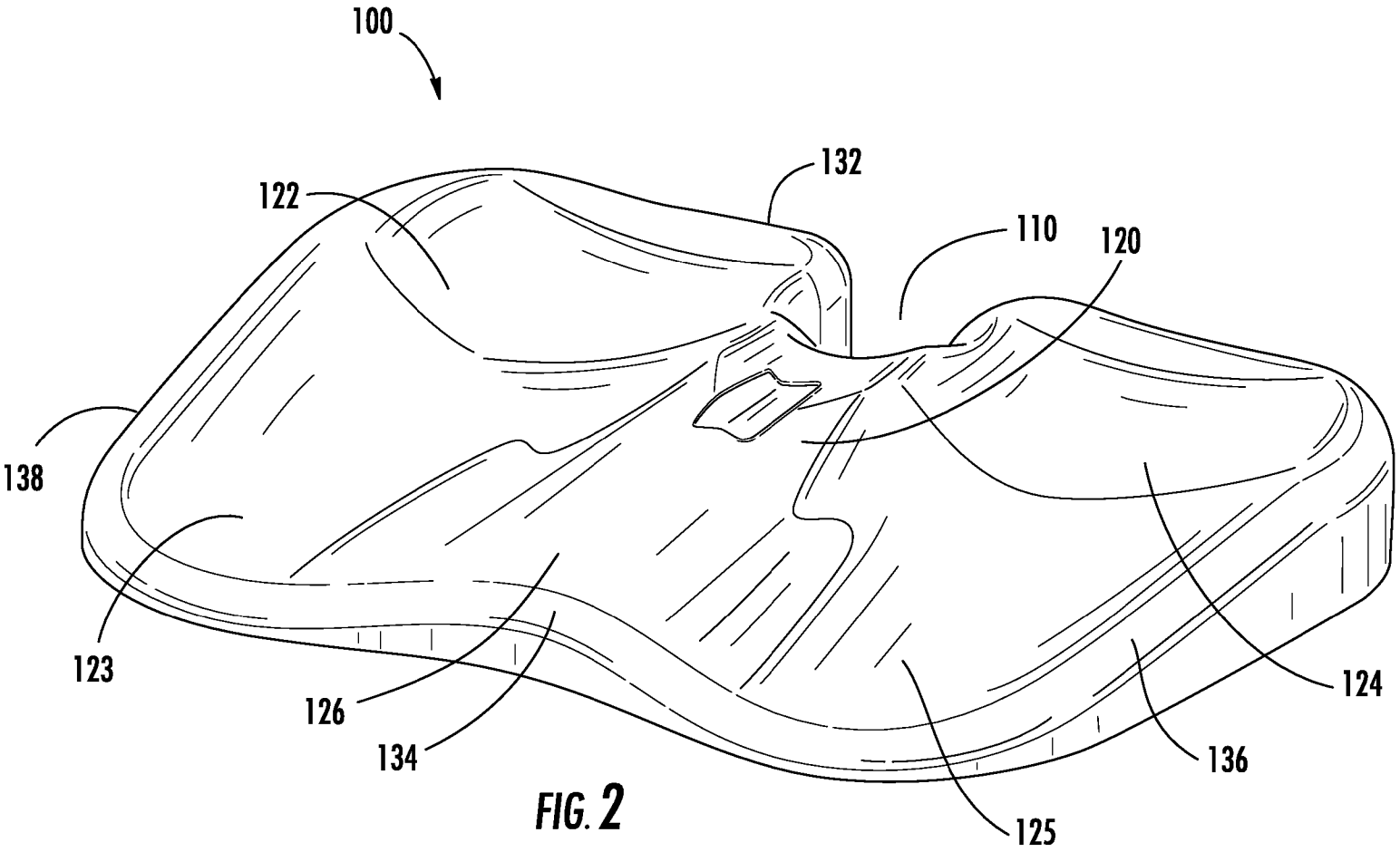
FIG. 2 is a top, right-side perspective view illustrating the device of FIG. 1.
Figure 3:
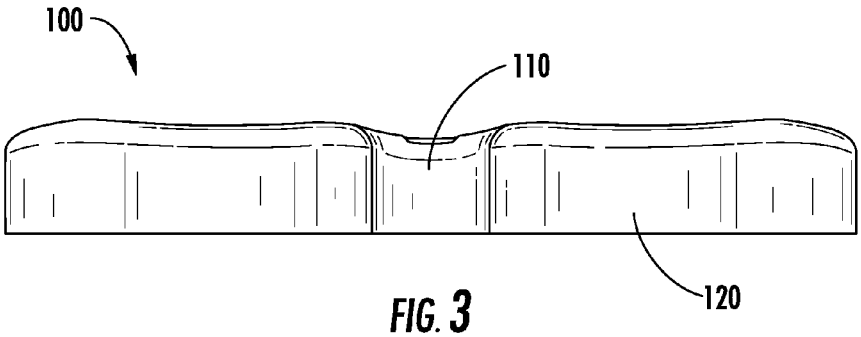
FIG. 3 is a back-side plan view illustrating the device of FIG. 1.
Figure 4:
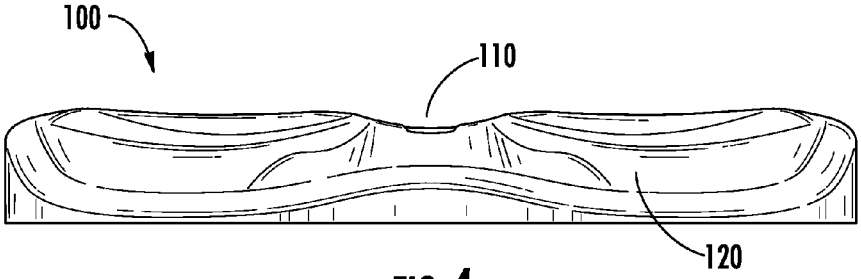
FIG. 4 is a front-side plan view illustrating the device of FIG. 1.
Figure 5:
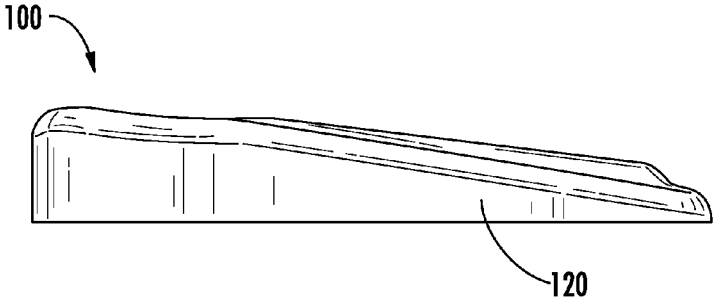
FIG. 5 is a left-side plan view illustrating the device of FIG. 1.
Figure 6:
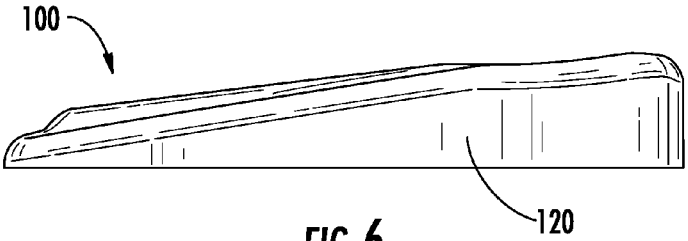
FIG. 6 is a right-side plan view illustrating the device of FIG. 1.
Figure 7:
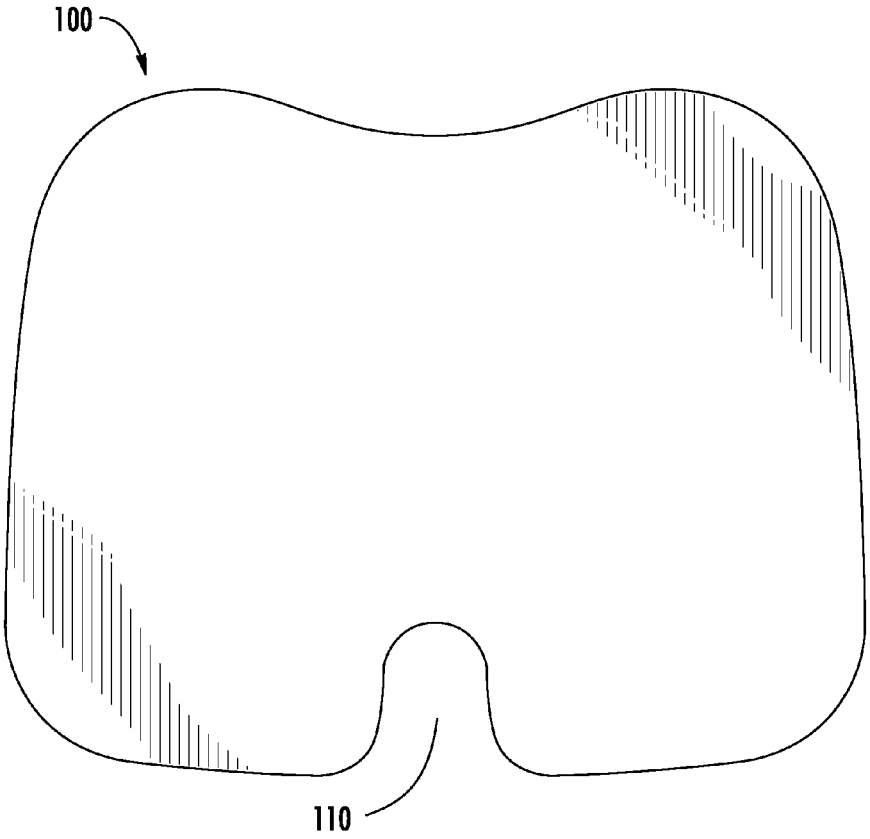
FIG. 7 is a bottom plan view illustrating the device of FIG. 1.

Referring to the drawings and, in particular, FIGS. 1-7, there is presented a device 100, according to one embodiment of the present invention. The device 100 includes a body 120. The device 100 includes four sides: a first lateral side 132, a fourth lateral side 136, a third lateral side 134, and a second lateral side 138. At least one of the first lateral side 132, the fourth lateral side 136, the third lateral side 134, and the second lateral side 138 may be either curvilinear or substantially straight. The invention is not limited to any particular degree of curvature or linearity for any of the sides. In the embodiment presented in FIGS. 1 and 2, the second lateral side 138 and the fourth lateral side 136 are substantially straight or linear. The third lateral side 134 may be curved as presented in FIGS. 1 and 2. For example, the middle portion of the third lateral side 134 may be curved inward while the outer portions of the third lateral side 134 may be curved outward. In embodiments of the invention, the shape of the device 100 may be substantially similar to or different from the shape of the device 100 presented in FIGS. 1-7. For example, the device 100 may have a substantially elliptical shape, a substantially rectangular shape, a substantially triangular shape, a substantially circular shape, a substantially square shape, a substantially polygonal shape, etc. The invention is not limited to any particular shape for the device 100. In one embodiment, as indicated in FIGS. 1 and 2, the third lateral side 134, the first lateral side 132, the second lateral side 138, and the fourth lateral side 136 are flared (e.g., opened outward) in order to further reduce pressure on areas of a person's body in contact with the device 100. Additionally, one or more of the first lateral side 132, the third lateral side 134, the second lateral side 138, and the fourth lateral side 136 may be raised above the plane of the first surface of the body 120.

In one embodiment, at least one of the third lateral side 134 or the first lateral side 132 may be longer, as long as, or shorter than at least one of the fourth lateral side 136 or second lateral side 138. In one embodiment, the third lateral side 134 may be longer, as long as, or shorter than the first lateral side 132. In one embodiment, the fourth lateral side 136 may be longer, as long as, or shorter than the second lateral side 138. The invention is not limited to any particular dimensions (length, width, thickness) of the device 100, which can be based upon the anticipated size of the user.

In embodiments where the body 120 has a polygonal shape, each of the third lateral side 134, the first lateral side 132, the fourth lateral side 136, or the second lateral side 138 may include one or more sides. For example, where the body 120 has a pentagonal shape, the third lateral side 134 may comprise two sides of the pentagon, while each of the first lateral side 132, the fourth lateral side 136, and the second lateral side 138 may include a single side of the pentagon. As a further example, where the body 120 has a twelve-sided (or twelve-sided) shape, each of the third lateral side 134, the first lateral side 132, the fourth lateral side 136, and the second lateral side 138 may include four sides of the twelve-sided body 120.

Alternatively, in embodiments where the body 120 has less than four sides, two or more sides may combine to form a single side of the body 120. For example, where the body 120 has a triangular shape, two of the sides (from the third lateral side 134, the first lateral side 132, the fourth lateral side 136, and the second lateral side 138) may combine to form a single side of the triangular-shaped body. As a further example, where the body 120 has a two-sided (or two-sided) shape, two of the sides may combine to form one of the sides of the two-sided body 120, while the other two sides may combine to form the remaining side of the two-sided body 120.

In one embodiment, the thickness of body 120 may be substantially consistent throughout the volume of the body 120. In other embodiments, the thickness of the body 120 may vary throughout the volume of the body 120. For example, the thickness of the body 120 may be greatest along the first lateral side 132 and smallest along the third lateral side 134. Therefore, the body 120 has a tapered thickness from the first lateral side 132 to the third lateral side 134. Thus, the body 120 may have a downward slope from the first lateral side 132 towards the third lateral side 134. This downward slope makes it easier for a person sitting on the device 100 on a seat to position his or her legs under an object (e.g., table, desk, driving wheel, etc.) situated in front of the seat. Additionally, the downward slope makes it easier for a person sitting on the device 100 to reach under the object if the person needs access to something under the object or on the ground under the object. Additionally, this downward slope makes it easier for a person sitting on the device 100 to settle into a seated position on the device 100 or to emerge from a seated position on the device 100. Therefore, the device 100 may be used as sitting aid in a various number of situations such as when a person is seated on the ground, when a person is seated on a chair that is positioned under a surface such as a table or desk, when a person is sitting in a driver's seat of a car, etc.

The device 100 also includes a first aperture 110. The first aperture 110 may comprise a depression formed in the first surface of the body 120 along or near the first lateral side 132 of the body 120. The first aperture 110 extends inwards into the body 120. The first aperture 110 presented in FIGS. 1-7 is for exemplary purposes only, and the first aperture 110 may extend more or less into the body 120 (in any direction) than the first aperture 110 presented in FIGS. 1-7. In one embodiment as shown in FIGS. 1-7, the first aperture 110 extends from the first surface of the body 120 at least partially through the second surface of the body 120. In one embodiment, the first aperture 110 has at least one of a substantially elliptical shape, a substantially rectangular shape, a substantially triangular shape, a substantially circular shape, a substantially square shape, a substantially polygonal shape, etc. However, the shape of the first aperture 110 is not limited to the shapes described herein. A person sits on the device 100 such that the person's tailbone is positioned above at least a portion of the first aperture 110. By positioning the first aperture 110 to align with the person's tailbone, the pressure exerted on the tailbone is reduced thus resulting in a more comfortable sitting experience. The first aperture 110 may also be referred to as an "opening," a "coccyx opening," or a "coccyx cut-out."

In one embodiment, the device 100 is substantially symmetrical about a line of axis that passes through the first aperture 110 and is substantially parallel to at least one of the second lateral side 138 or the fourth lateral side 136. In other embodiments, the device 100 may not be substantially symmetrical about a line of axis that passes through the first aperture 110 and is substantially parallel to at least one of the second lateral side 138 or the fourth lateral side 136.

In FIGS. 1-7, there are several contour lines illustrated on the first surface of the body 120. In one embodiment, an area of the first surface (or the underlying portion of the body 120) defined by one or more contour lines may be designed to seat a particular portion of a person's body. For example, in one embodiment, the first surface comprises at least one recess 124 near the fourth lateral side 136 and at least one recess 122 near the second lateral side 138. These recesses enable a person to properly position the person's posterior region on the device 100. Additionally, the first surface further comprises at least one raised portion 126 near the third lateral side 134. This raised portion 126 enables a person to properly position the person's pelvic region on the device 100. Additionally, FIG. 2 illustrates portions 123 and 125 on the first surface. In one embodiment, these portions 123 and 125 are also recessed. The portions 123 and 125 may be more recessed or less recessed when compared to the portions 122 and 124.

Figure 8:
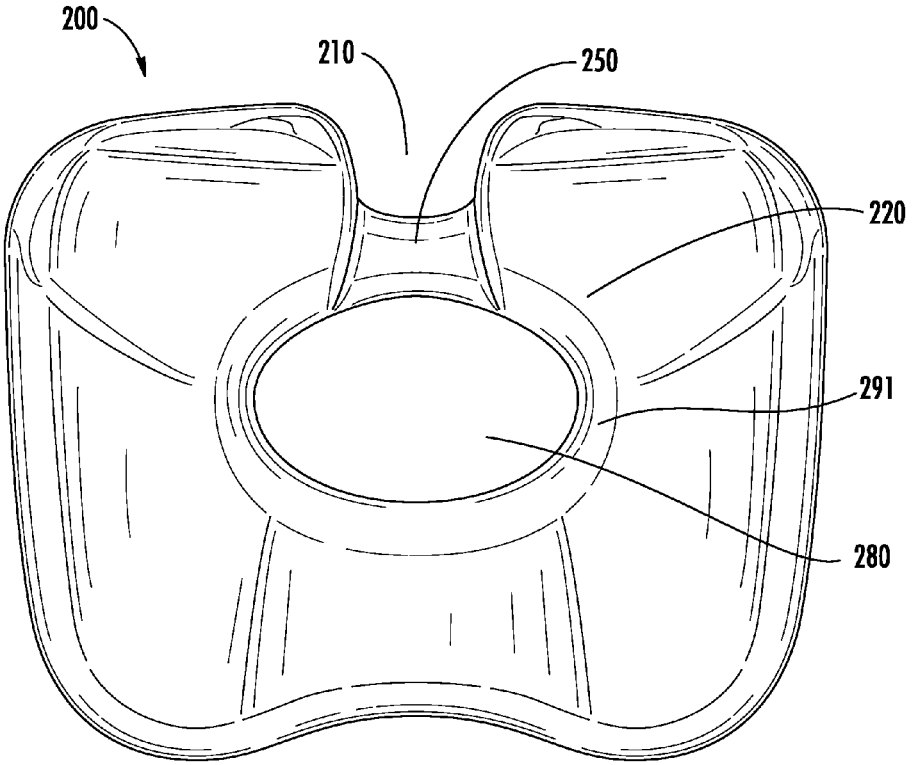
FIG. 8 is a top plan view illustrating a device, according to a second embodiment of the invention.
Figure 9:
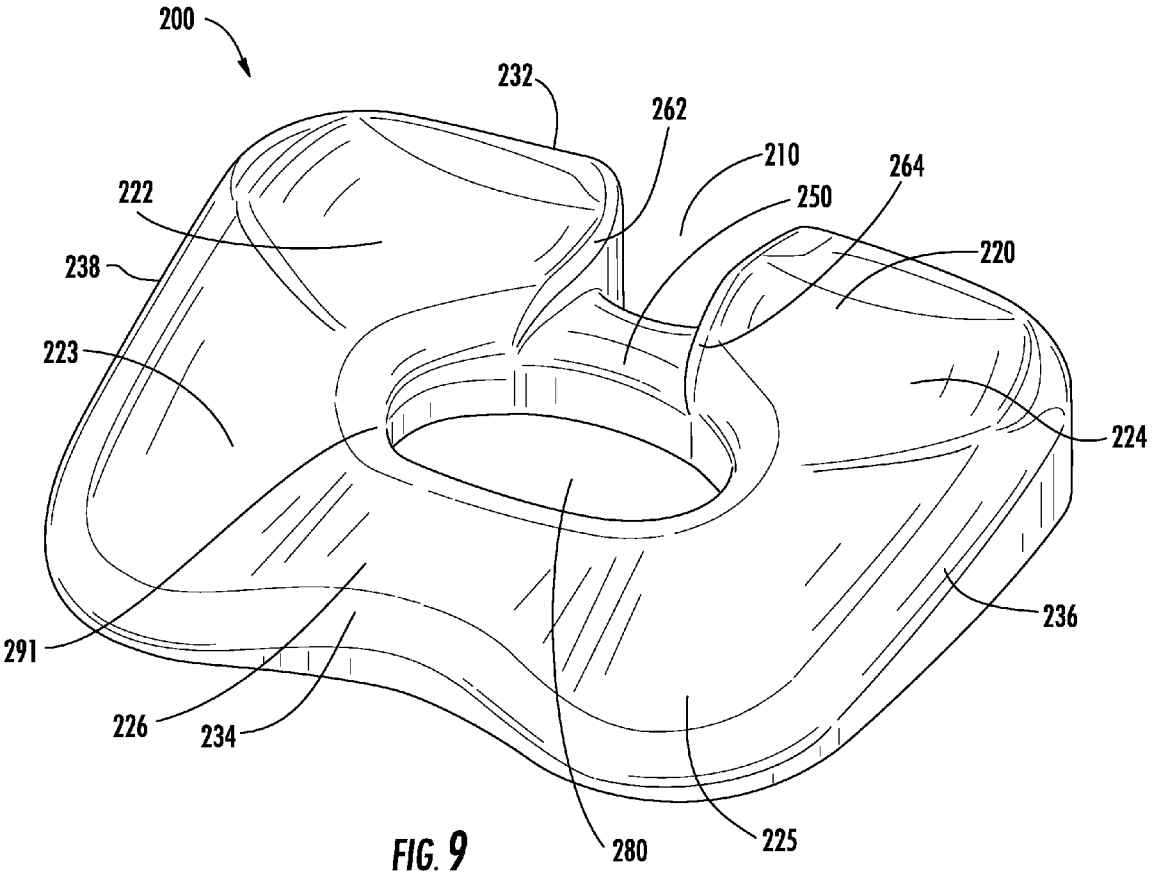
FIG. 9 is a top, right-side perspective view illustrating the device of FIG. 8.
Figure 10:
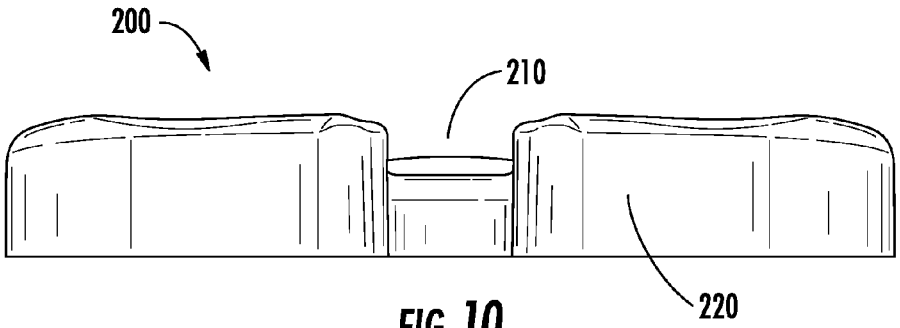
FIG. 10 is a back-side plan view illustrating the device of FIG. 8.
Figure 11:
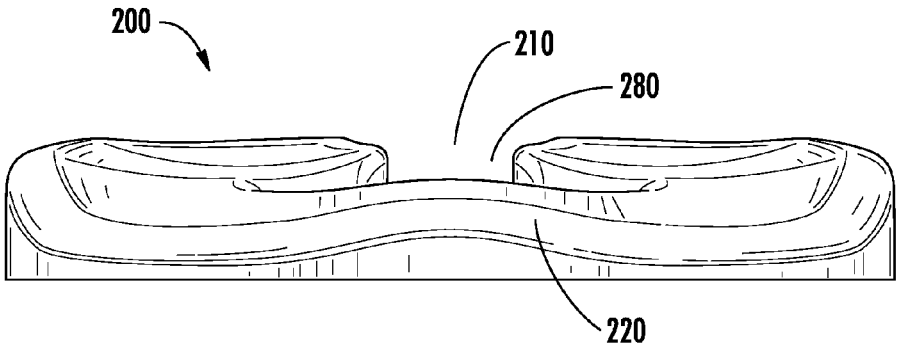
FIG. 11 is a front-side plan view illustrating the device of FIG. 8.
Figure 12:
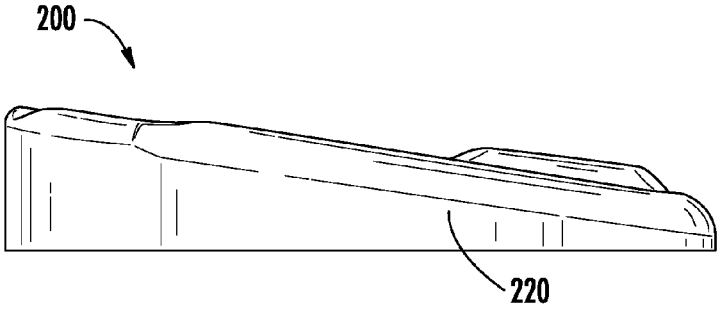
FIG. 12 is a left-side plan view illustrating the device of FIG. 8.
Figure 13:
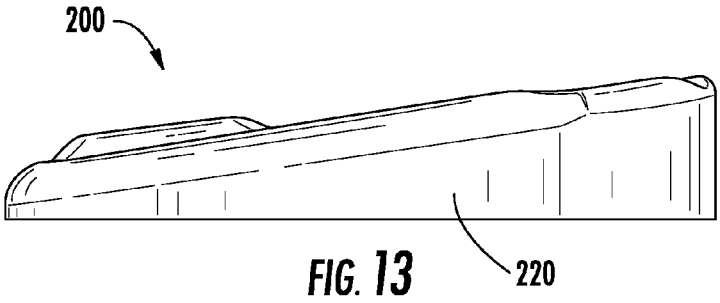
FIG. 13 is a right-side plan view illustrating the device of FIG. 8.
Figure 14:
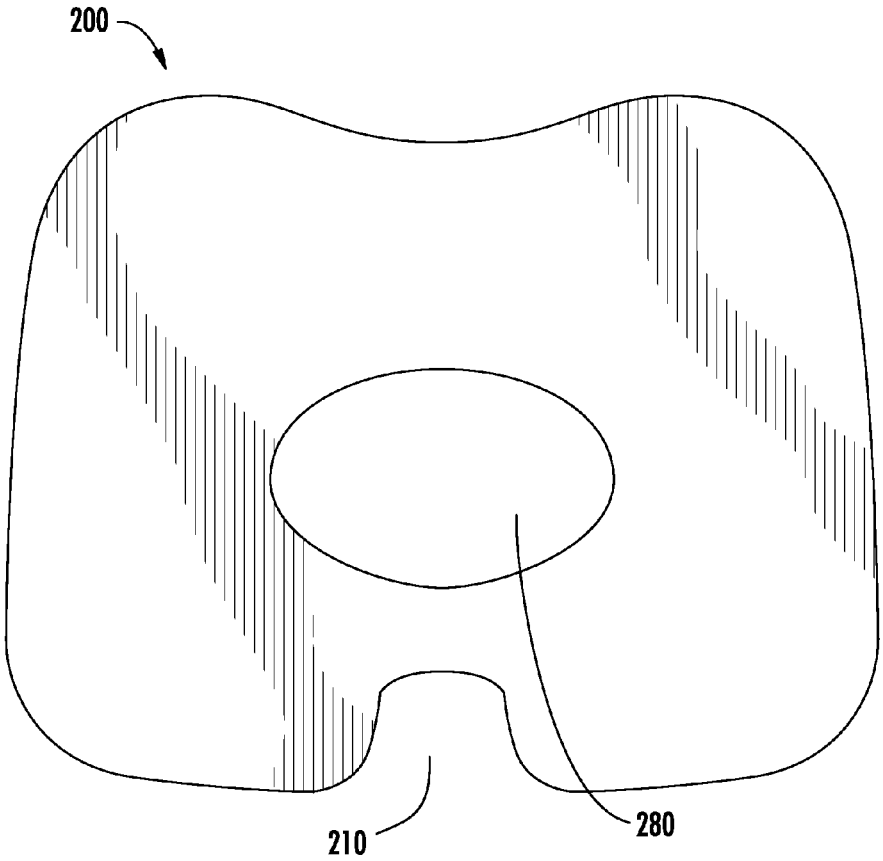
FIG. 14 is a bottom plan view illustrating the device of FIG. 8.
Figure 15:
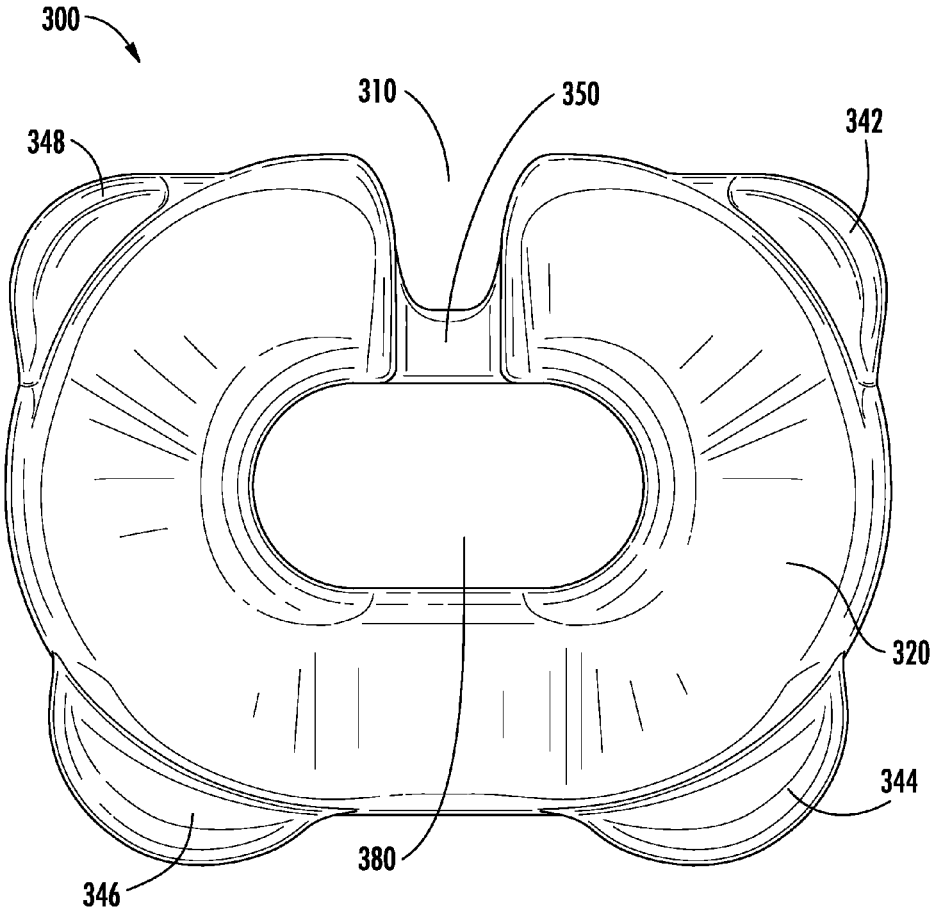
FIG. 15 is a top plan view illustrating a device, according to a third embodiment of the invention.

Referring to FIGS. 8-14, FIGS. 8-14 present a second embodiment of the device 200. The features described with respect to the first embodiment in FIGS. 1-7 are also applicable to the second embodiment presented in FIGS. 8-14. For example, FIG. 9 illustrates the first lateral side 232, the third lateral side 234, the second lateral side 238, and the fourth lateral side 236. Additionally, one or more of the first lateral side 232, the third lateral side 234, the second lateral side 238, and the fourth lateral side 236 may be raised above the plane of the first surface of the body 220. As a further example, FIG. 9 illustrates recesses 222 and 224, and raised portion 226. As a further example, FIG. 9 illustrates portions 223 and 225 on the first surface. In one embodiment, these portions 223 and 225 are also recessed. The portions 223 and 225 may be more recessed or less recessed when compared to the portions 222 and 224. As a further example, one or more of the first lateral side 232, the third lateral side 234, the second lateral side 238, and the fourth lateral side 236 may be raised above the plane of the first surface of the body 220.

FIGS. 8-14 illustrate a second device 200, according to a second embodiment of the present invention. The device 200 includes a second aperture 280. In one embodiment, the second aperture 280 is positioned approximately about the centroid of the body 220. In another embodiment, the second aperture 280 is positioned so as to be offset from the centroid of the body 220. In one embodiment, the second aperture 280 extends into the body. In another embodiment, the second aperture 280 extends at least partially through the second surface of the body 220. The second aperture 280 has at least one of a substantially elliptical (or oval) shape, a substantially rectangular shape, a substantially triangular shape, a substantially circular shape, a substantially square shape, a substantially polygonal shape, etc. The invention is not limited to any particular shape for the second aperture 280. In embodiments where the second aperture 280 is substantially circular or elliptical, the invention is not limited to any particular radius or diameter for the second aperture 280.

A person sits on the device 200 such that the person's hemorrhoids are positioned above the second aperture 280. By positioning the second aperture 280 to align with the person's hemorrhoids, the pressure exerted on the hemorrhoids is reduced thus resulting in a more comfortable sitting experience.

In one embodiment, the sides 291 associated with this second aperture 280 (or associated with the first surface of the device 200) are flared (e.g., opened outward) in order to further reduce pressure on the hemorrhoid area and other areas of the person's body in contact with the device 200. Either collectively or individually, the second aperture 280, the first aperture 210, and the downward slope of the first surface reduce the number of pressure points (and/or the amount of pressure associated with each pressure point) on a person's body when seated on the device 200.

The second embodiment also includes a bridge 250 positioned at least partially between the first aperture 210 on a first side, the second aperture 280 on a second side, a first portion 262 of the body 220 on a third side, and a second portion 264 of the body 220 on a fourth side. In one embodiment, the bridge 250 is manufactured as an integral part of the body 220, while in other embodiments, the bridge 250 is manufactured separately from the body 220. The bridge 250 comprises a pillow-filling material that is either the same as or different from the pillow-filling material associated with the body 220. As indicated in FIGS. 8 and 9, the bridge 250 occupies a part of the first aperture 210, but not the entire first aperture 210. However, in alternate embodiments, the bridge 250 may substantially occupy the entire first aperture 210. As indicated in FIGS. 8 and 9, the bridge 250 extends from the side of the second aperture 280 towards the first lateral side 232, but does not extend all the way to the first lateral side 232. In alternate embodiments, the bridge 250 may extend all the way from the side of the second aperture 280 to the first lateral side 232. Additionally, the bridge 250 extends from the second surface towards the first surface of the body 220, but does not extend all the way up to the first surface. In alternate embodiments, the bridge 250 may extend all the way up from the second surface to the first surface. Therefore, the thickness of the bridge 250 is either greater than or not greater than a thickness associated with at least one of the first portion 262 of the body 220 or the second portion 264 of the body 220. The bridge 250 is useful because it prevents the first aperture 210 from closing or collapsing either partially or completely, which would cause pressure to be exerted on a person's tailbone or other parts of the person's body when the person is seated on the device 200. Additionally, the bridge 250 is useful because it keeps the left and right halves of the body 220 together and from separating.

Figure 16:
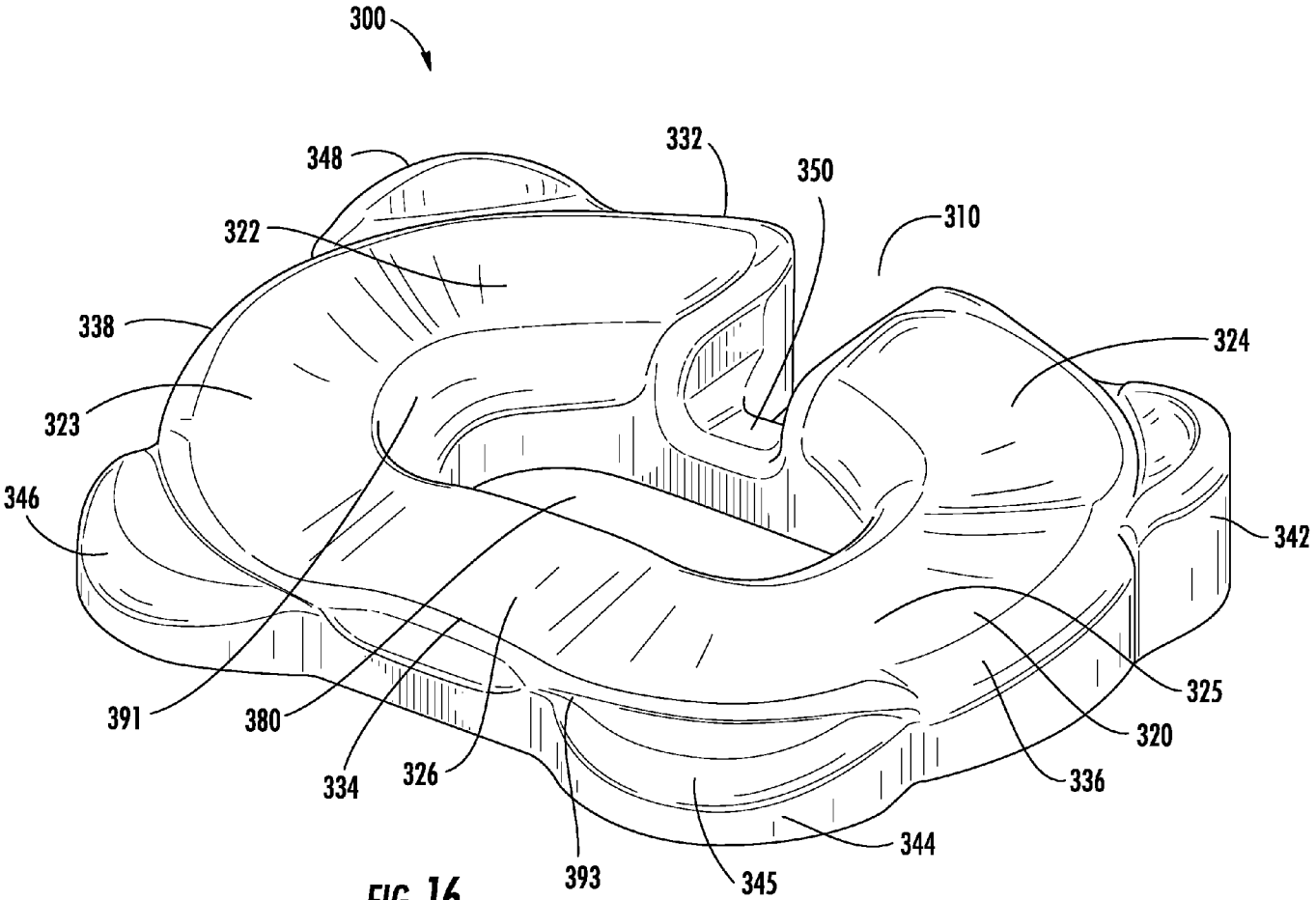
FIG. 16 is a top, right-side perspective view illustrating the device of FIG. 15.
Figure 17:
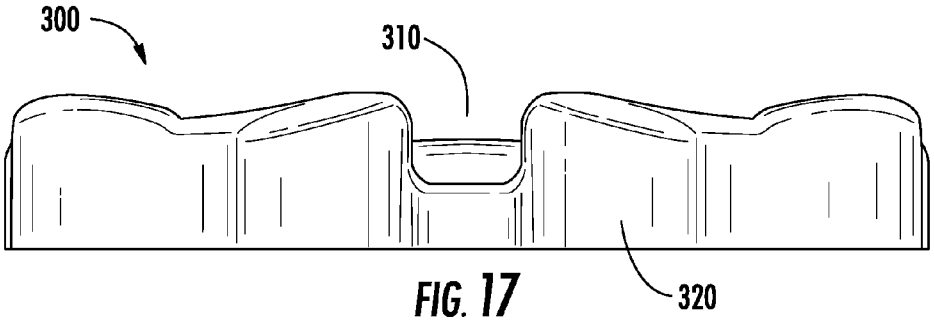
FIG. 17 is a back-side plan view illustrating the device of FIG. 15.
Figure 18:
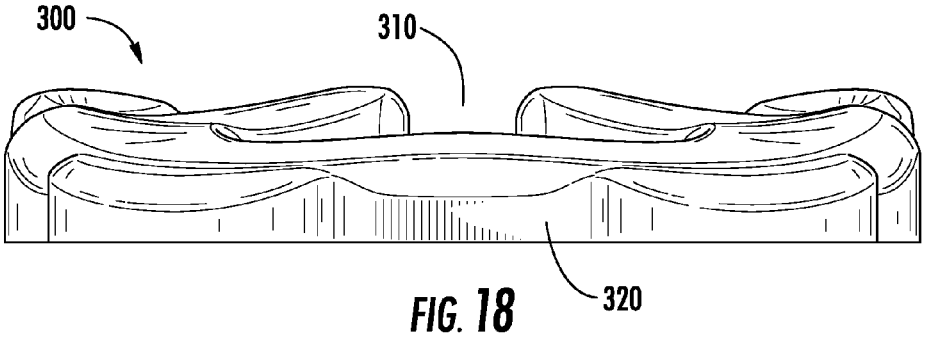
FIG. 18 is a front-side plan view illustrating the device of FIG. 15.
Figure 19:
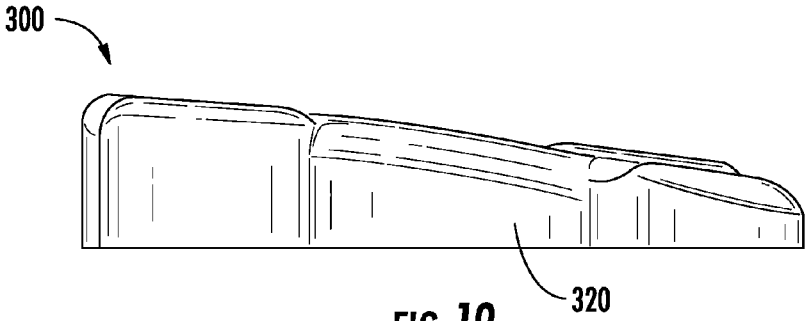
FIG. 19 is a left-side plan view illustrating the device of FIG. 15.
Figure 20:
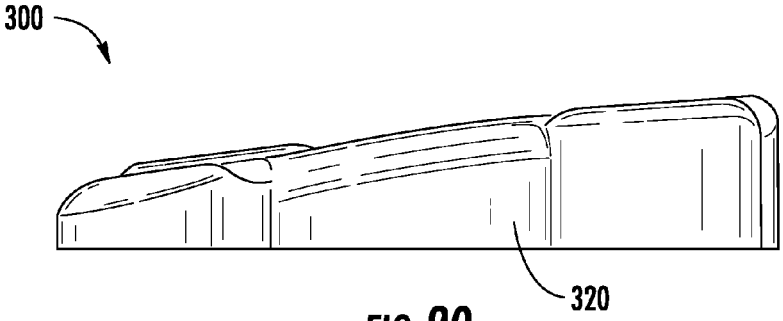
FIG. 20 is a right-side plan view illustrating the device of FIG. 15.
Figure 21:
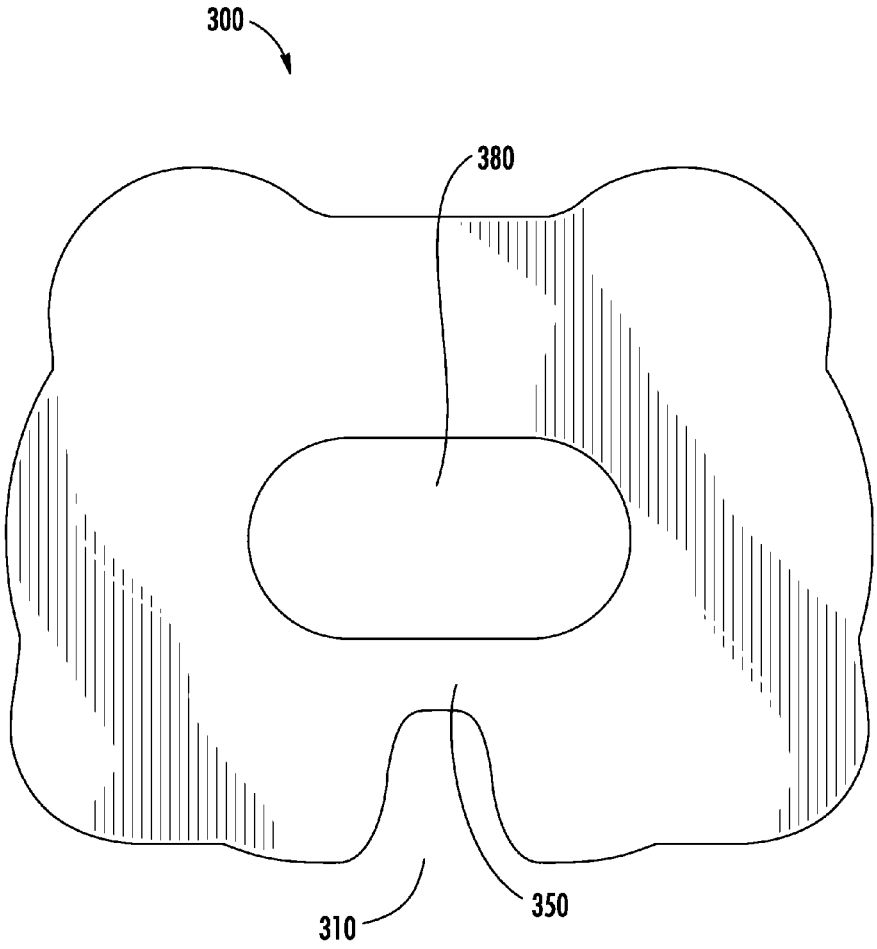
FIG. 21 is a bottom plan view illustrating the device of FIG. 15.

FIGS. 15-21 illustrates a device 300, according to a third embodiment of the present invention. The third embodiment may also be referred to as a "donut-shaped" device. The features described with respect to the first embodiment in FIGS. 1-7 and the second embodiment in FIGS. 8-14 are also applicable to the third embodiment presented in FIGS. 15-21. For example, FIG. 16 illustrates the first lateral side 332, the third lateral side 334, the second lateral side 338, and the fourth lateral side 336. As a further example, FIG. 16 illustrates recesses 322 and 324, and raised portion 326. Additionally, FIG. 16 illustrates portions 323 and 325 on the first surface. In one embodiment, these portions 323 and 325 are also recessed. The portions 323 and 325 may be more recessed or less recessed when compared to the portions 322 and 324. Additionally, one or more of the first lateral side 332, the third lateral side 334, the second lateral side 338, and the fourth lateral side 336 may be raised above the plane of the first surface of the body. Additionally, the device 300 includes a second aperture 380, a first aperture 310, and a bridge 350. Additionally, the sides 391 associated with the second aperture 380 (or associated with the first surface of the device 300) are flared (e.g., opened outward) in order to further reduce pressure on the hemorrhoid area and other areas of the person's body in contact with the device 300.

The third embodiment presented in FIGS. 15-21 includes additional features not present in the first embodiment and/or the second embodiment. For example, the third embodiment includes at least one of: a first lobe 348 positioned in a first corner defined by the first lateral side 332 and the second lateral side 338, wherein the first lobe 348 comprises pillow-filling material and extends beyond the at least one of the first lateral side 332 or the second lateral side 338; a second lobe 342 positioned in a second corner defined by the first lateral side 332 and the fourth lateral side 336, wherein the second lobe 342 comprises pillow-filling material and extends beyond the at least one of the first lateral side 332 or the fourth lateral side 336; a third lobe 346 positioned in a third corner defined by the third lateral side 334 and the second lateral side 338, wherein the third lobe 346 comprises pillow-filling material and extends beyond the at least one of the third lateral side 334 or the second lateral side 338; or a fourth lobe 344 positioned in a fourth corner defined by the third lateral side 334 and the fourth lateral side 336, wherein the fourth lobe 344 comprises pillow-filling material and extends beyond the at least one of the third lateral side 334 or the fourth lateral side 336. As used herein, a "lobe" refers to either the first lobe 348, the second lobe 342, the third lobe 346, or the fourth lobe 344. Each of the lobes provides stability and support for a user sitting on the device 300. Either individually or collectively, the lobes reduce the movement of the device 300 when a person sitting on the device 300 adjusts his or her sitting position, settles into a sitting position, or emerges from a sitting position. Additionally, as indicated in FIG. 16, the outside sides associated with the lobes (e.g., outside side 345 of the fourth lobe 344) are flared (e.g., opened outward). As used herein, a lobe may also be referred to as an "ear."

The at least one of the first lobe 348, the second lobe 342, the third lobe 346, or the fourth lobe 344 is either manufactured integrally as a part of the body 320 or is detachably hinged to the body 320. As used herein, the term "hinged" refers to a lobe being connected to the body 320 using a detachable or non-detachable connection. As used herein, "detachable" means that the connection is structured to be connected and disconnected by a user (e.g., using an adhesive, a mechanical fastener, such as a zipper or a loop and hook fastener, snaps, etc.). In the embodiment presented in FIGS. 15 and 16, at least one of the first lobe 348, the second lobe 342, the third lobe 346, or the fourth lobe 344 has at least one inner curved side, wherein the at least one inner curved side is hinged to at least one of the first corner, the second corner, the third corner, or the fourth corner of the body 320. An example of the inner curved side 393 of the fourth lobe 344 is illustrated in FIG. 16. In FIGS. 15-21, each of the lobes is illustrated as having a semi-circular or semi-elliptical shape. However, the invention is not limited to any particular shape for a lobe.

The pillow-filling material comprised within the at least one of the first lobe 348, the second lobe 342, the third lobe 346, or the fourth lobe 344 is either the same as or different from pillow-filling material comprised within the body 320. In one embodiment, each of the lobes may be manufactured by sculpting or shaping a solid block of pillow-filling material. In other embodiments, each of the lobes may be manufactured to be substantially hollow, and the lobes may be filled with pillow-filling material. A substantially hollow lobe may be made of plastic (e.g., polyvinyl chloride or PVC) or any other type of flexible or inflexible material. In alternate embodiments, each of the lobes may include a fitted or unfitted cover. The cover may be constructed of a variety of materials, including synthetic and natural fabrics and natural/synthetic blends. For purposes of example, and not limitation, the cover can be constructed of silk, cotton, or polyester. The cover may be inflatable and/or deflatable based on a user's wishes. Therefore, in one embodiment, each of the lobes may have one or more apertures (and a closing mechanism such as a cap) to receive and retain pillow-filling material.

The invention is not limited to any particular dimensions (length, breadth, thickness) for a lobe. The thickness of the first lobe 348 may be either greater than or not greater than a thickness of the body 320 at the first corner. Additionally or alternatively, a thickness of the second lobe 342 may be either greater than or not greater than a thickness of the body 320 at the second corner. Additionally or alternatively, a thickness of the third lobe 346 may be either greater than or not greater than a thickness of the body 320 at the third corner. Additionally or alternatively, a thickness of the fourth lobe 344 may be either greater than or not greater than a thickness of the body 320 at the fourth corner. Additionally, each of lobes may have different dimensions.

Figure 22:
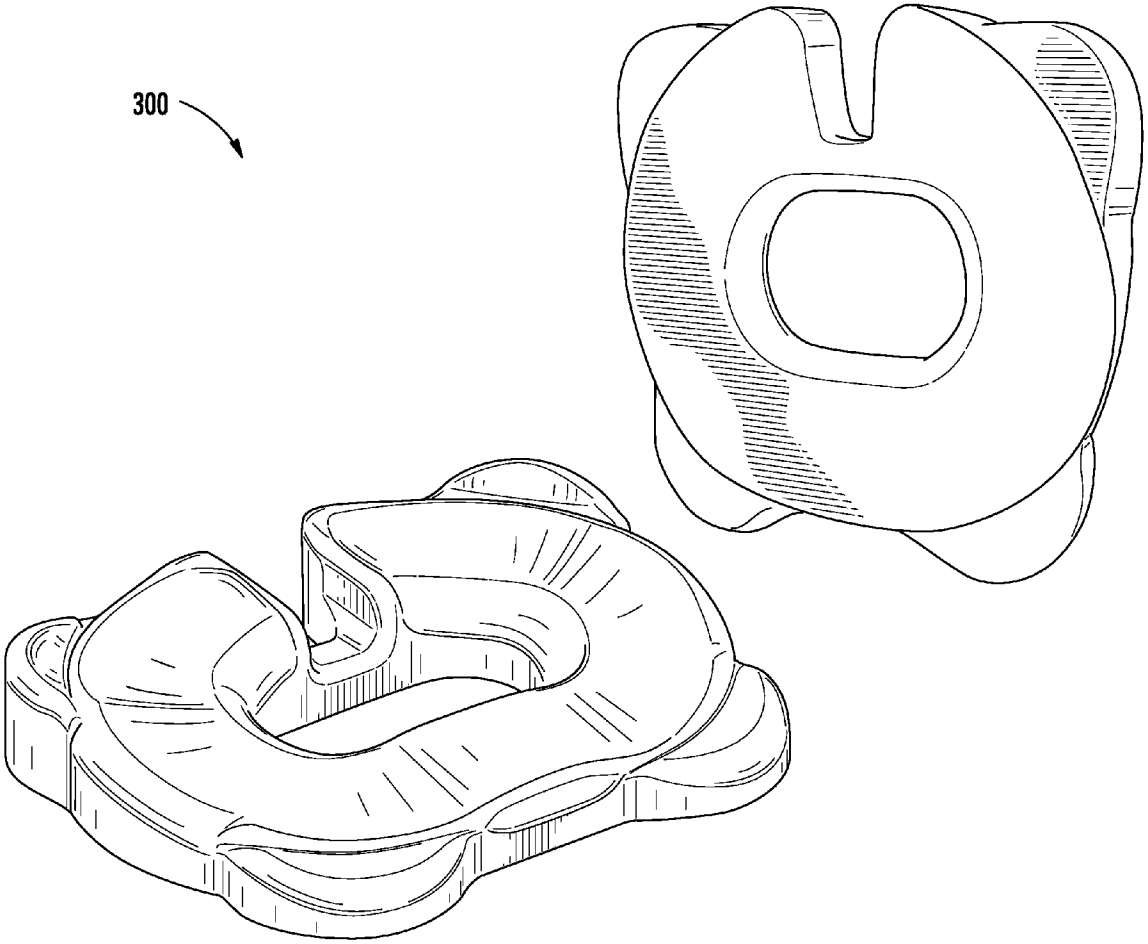
FIG. 22 illustrates a left, bottom perspective view and left, top perspective view of the device of FIG. 15.

FIG. 22 illustrates other views of the device according to the third embodiment of the invention.

Figure 23:
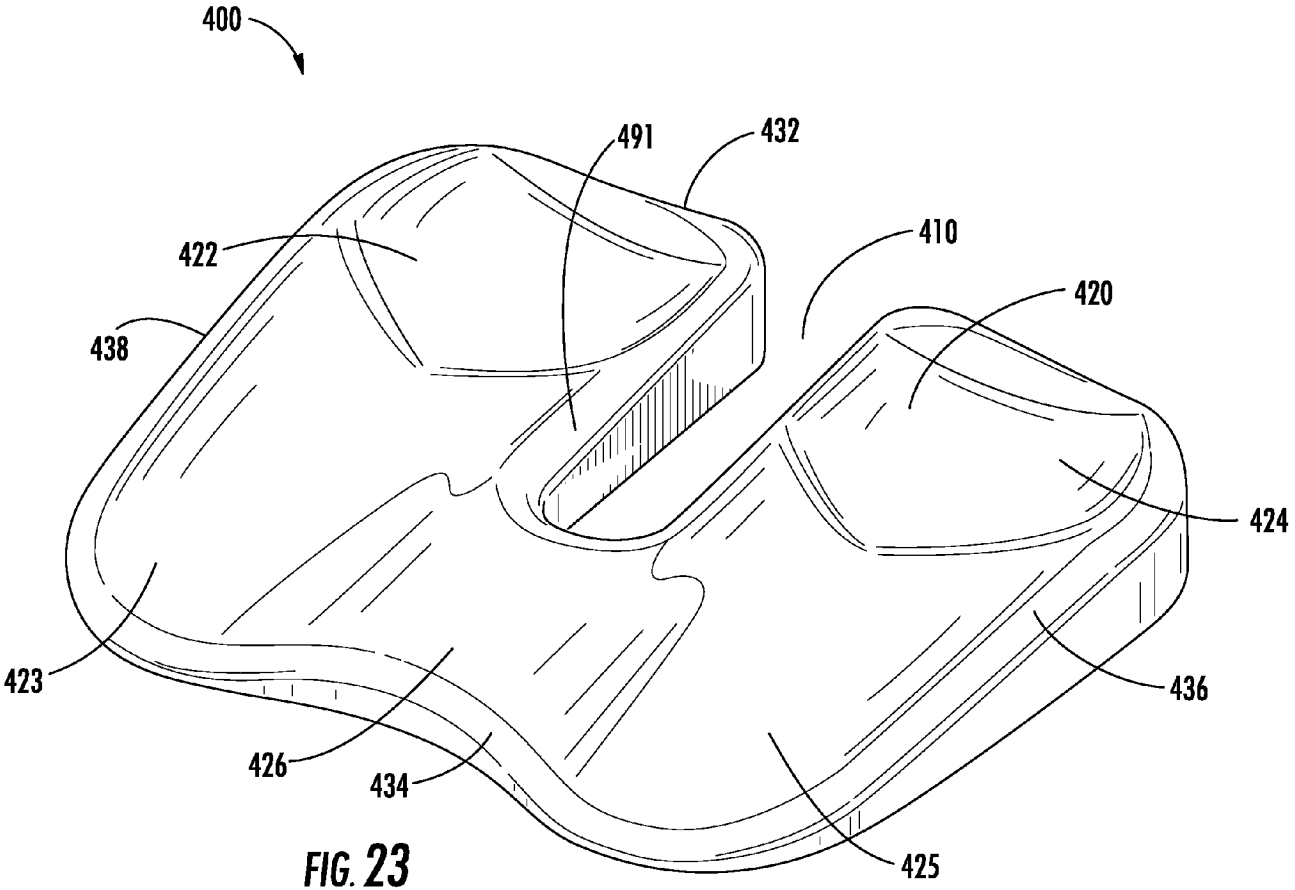
FIG. 23 is a top, right-side perspective view illustrating a device, according to a fourth embodiment of the invention.

FIG. 23 illustrates a device 400, according to a fourth embodiment of the present invention. The features described with respect to the first embodiment in FIGS. 1-7 are also applicable to the fourth embodiment presented in FIG. 23. For example, FIG. 23 illustrates the first lateral side 432, the third lateral side 434, the second lateral side 438, and the fourth lateral side 436. As a further example, FIG. 23 illustrates recesses 422 and 424, and raised portion 426. As a further example, FIG. 23 presents portions 423 and 425 on the first surface. In one embodiment, these portions 423 and 425 are also recessed. The portions 423 and 425 may be more recessed or less recessed when compared to the portions 422 and 424. As a further example, one or more of the first lateral side 432, the third lateral side 434, the second lateral side 438, and the fourth lateral side 436 may be raised above the plane of the first surface of the body 420.

The fourth embodiment illustrated in FIG. 23 includes additional features not present in the first embodiment. For example, the first aperture 410 extends from the first lateral side 432 towards or to near a substantially central portion of the body 420. A person sits on the device 400 such that the person's tailbone and hemorrhoids are positioned on the first aperture 410. By positioning the first aperture 410 to align with the person's tailbone and hemorrhoids, the pressure exerted on both the tailbone and the hemorrhoids is reduced thus resulting in a more comfortable sitting experience. Additionally, the configuration also makes it more comfortable for a person to settle into a sitting position or to emerge from a sitting position. The portion of the first aperture 410 that extends beyond the first aperture 410 illustrated in FIGS. 1-7 may be referred to as the extended portion of the first aperture 410. The sides 491 associated with this extended portion (or associated with the first surface of the device 400) are flared (e.g., opened outward) in order to further reduce pressure on the hemorrhoid area.

As explained previously, in one embodiment of the invention, the body of the device may be substantially hollow. In such embodiments, the device presented as the first embodiment, the second embodiment, the third embodiment, or the fourth embodiment may further include an aperture through which pillow-filling material can either be injected into or removed from the body. After pillow-filling material is injected into the body via the aperture, the aperture may be closed using a closing or locking mechanism (e.g., a cap). The location of the aperture is not limited to any particular position on the body. For example, the aperture may be positioned on the first surface, on the second surface, on any of the sides or corners, etc.

In one embodiment, a gel pack that comprises fluid may be inserted into the aperture in order to fill the body with fluid. Additionally, an empty or partially empty gel pack may also be inserted into the aperture in order remove fluid that is comprised within the body. As used herein, fluid that is used to fill the body may either be hot fluid or cold fluid. The invention is not limited to any particular range of temperatures associated with the fluid. Some assemblies may include one or more apertures positioned on one or more parts of the body. In one embodiment, each lobe in the third embodiment may also include one or more apertures such that pillow-filling material can be injected into the lobe or removed from the lobe via the one or more apertures.

Figure 24:
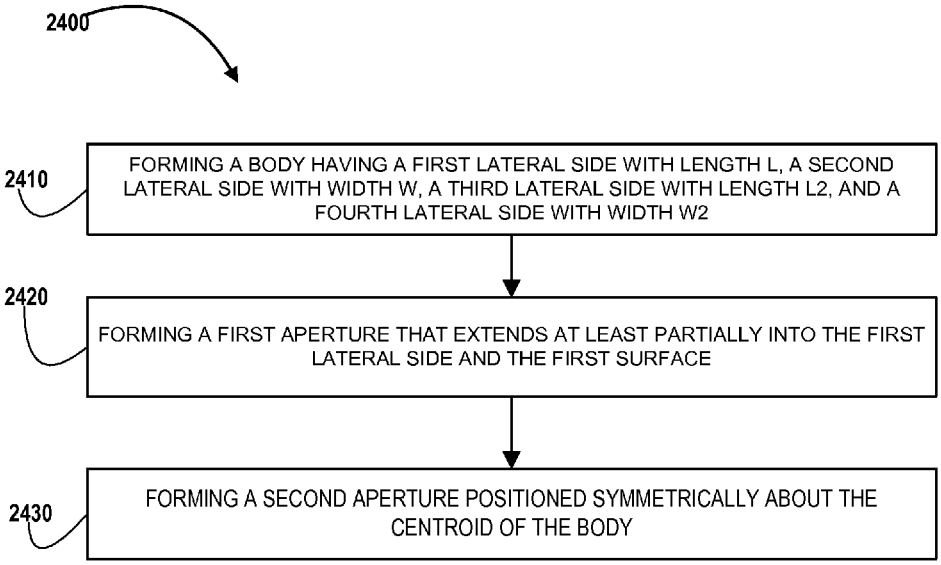
FIG. 24 is a process flow associated with constructing a device, according to one embodiment of the invention.

Referring now to FIG. 24, FIG. 24 presents a method 2100 of manufacturing a device described with respect to at least one of the first embodiment, the second embodiment, the third embodiment, or the fourth embodiment. At block 2410, the method comprises the step of forming a body having a first lateral side with length L, a second lateral side with width W, a third lateral side with length L2, and a fourth lateral side with width W2, wherein the body defines a first surface and a second surface. In one embodiment, the forming of the body includes the step of casting the body or sculpting or shaping a solid block of pillow-filling material into the shape of the body. In other embodiments, the forming of the body includes the step of forming a substantially flexible or inflexible hollow body of a desired shape, and filling the substantially hollow body with pillow-filling material described herein.

The process of forming the body additionally includes the steps of forming a first aperture in the first surface extending into the body near the first lateral side (block 2420) and/or forming a second aperture that extends from the first surface to the second surface in a substantially central portion of the body (block 2430).

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation. In addition, where possible, any terms expressed in the singular form herein are meant to also include the plural form and/or vice versa. As used herein, "at least one" shall mean "one or more" and these phrases are intended to be interchangeable. Accordingly, the terms "a" and/or "an" shall mean "at least one" or "one or more," even though the phrase "one or more" or "at least one" is also used herein.

What is claimed is:

1. A device for reducing pressure, comprising:

a body having a first, second and third lateral sides, a first surface, and a second surface, at least a portion of the first surface defining a first aperture therein and at least a portion of the first surface defining a second aperture therein, wherein the body extends along the entire perimeter of the second aperture, and wherein at least a portion of the first aperture impinges at least a portion of the second aperture; and a first lobe extending from the body approximate the intersection of the first and second lateral sides so to define a first corner, the first lobe defining a first surface and a second surface and wherein the first lobe has a thickness comprising the distance between the closest points of the first surface and the second surface of the first lobe;

a second lobe extending from the body approximate the intersection of the second and third lateral sides so to define a second corner, the second lobe defining a first surface and a second surface and wherein the second lobe has a thickness comprising the distance between the closest points of the first surface and the second surface of the second lobe; and wherein the thickness of the second lobe is less than the thickness of the first lobe and wherein the second surface of the first and second lobes are substantially planar with the respective portion of the second surface of the body that is adjacent the first and second lobes, respectively, to thereby provide stability and support for a user sitting on the device by reducing movement of the device.

2. The device of claim 1, wherein the body defines a fourth lateral side and wherein the thickness of the body along the first lateral side is greater than the thickness of the body along the third lateral side such that the first surface slopes downwards from the first lateral side towards the third lateral side.

3. The device of claim 1, wherein the first surface further comprises at least one recess.

4. The device of claim 3, wherein the body defines a fourth lateral side and wherein the first surface comprises a first recess within the corner defined by the second lateral side and the first lateral side and second recess within the corner defined by the fourth lateral side and the first lateral side.

5. The device of claim 1, wherein the body defines a fourth lateral side and wherein the first surface of the body further comprises at least one raised portion extending from the third lateral side toward the first aperture.

6. The device of claim 1, wherein the body defines a fourth lateral side and wherein at least one of the second lateral side, the first lateral side, the third lateral side, and the fourth lateral side are curved such the body has a substantially circular or elliptical shape.

7. The device of claim 1, wherein at least a portion of the first aperture extends from the first surface through a second surface.

8. The device of claim 1, wherein at least a portion of the first aperture extends from the first lateral side to near a centroid of the body.

9. The device of claim 1, wherein the first aperture has at least one of a substantially elliptical shape, a substantially rectangular shape, a substantially triangular shape, a substantially circular shape, a substantially square shape, or a substantially polygonal shape.

10. The device of claim 1, wherein at least a portion of the second aperture extends through a second surface.

11. The device of claim 1, wherein the second aperture has at least one of a substantially elliptical shape, a substantially rectangular shape, a substantially triangular shape, a substantially circular shape, a substantially square shape, or a substantially polygonal shape.

12. The device of claim 1, further comprising a bridge positioned at least partially in the first aperture, the bridge being configured to prevent the sides of the aperture from separating.

13. The device of claim 1, wherein the body defines a fourth lateral side and wherein the body is substantially symmetrical about a line of axis that passes through the first aperture and is substantially parallel to at least one of the second lateral side or the fourth lateral side.

14. The device of claim 1, wherein the body is constructed of high-density foam.

15. The device of claim 4, wherein a width associated with at least one of the second lateral side or the fourth lateral side is not equal to the length associated with at least one of the third lateral side or first lateral side.

16. The device of claim 1, wherein the body further comprises an aperture to inject a pillow-filling material into the body and to remove pillow-filling material from the body.

17. A method for manufacturing a device, the method comprising:

forming a body having a first lateral side, a second lateral side, a third lateral side, and a fourth lateral side, the body defining a first surface and a second surface;

forming a first aperture in the first surface of the body extending at least partially into the body; and forming a second aperture in the first surface of the body extending at least partially into the body, wherein the body extends along the entire perimeter of the second aperture, and wherein at least a portion of the first aperture impinges at least a portion of the second aperture;

forming a first lobe extending from the body approximate the intersection of the first and second lateral sides so to define a first corner, the first lobe defining a first surface and a second surface and wherein the first lobe has a thickness comprising the distance between the closest points of the first surface and the second surface of the first lobe;

forming a second lobe extending from the body approximate the intersection of the second and third lateral sides so to define a second corner, the second lobe defining a first surface and a second surface and wherein the second lobe has a thickness comprising the distance between the closest points of the first surface and the second surface of the second lobe and wherein the thickness of the second lobe is less than the thickness of the first lobe and wherein the second surface of the first and second lobes are substantially planar with the respective portion of the second surface of the body that is adjacent the first and second lobes, respectively, to thereby provide stability and support for a user sitting on the device by reducing movement of the device.

18. The method for manufacturing a device according to claim 17, wherein the thickness of the body along the first lateral side is greater than a thickness of the body along the third lateral side such that the first surface slopes downwards from the first lateral side towards the third lateral side.

19. The device of claim 1, wherein at least one of the first and second lobes has a thickness greater than a thickness of the body adjacent the at least one of the first and second lobes.

20. The device of claim 1, wherein at least one of the first and second lobes has a thickness less than a thickness of the body adjacent the at least one of the first and second lobes.

* * * * *